US008309014B2

(12) United States Patent
Piepenburg

(10) Patent No.: US 8,309,014 B2
(45) Date of Patent: Nov. 13, 2012

(54) METHOD OF TRIMMING UNFIRED POTTERY USING A TURNTABLE APPARATUS

(76) Inventor: Robert E. Piepenburg, Ann Arbor, MI (US)

( * ) Notice: Subject to any disclaimer, the term of this patent is extended or adjusted under 35 U.S.C. 154(b) by 654 days.

(21) Appl. No.: 12/604,807

(22) Filed: Oct. 23, 2009

(65) Prior Publication Data

US 2010/0044906 A1 Feb. 25, 2010

Related U.S. Application Data

(62) Division of application No. 11/824,377, filed on Jun. 29, 2007, now abandoned.

(60) Provisional application No. 60/831,758, filed on Jul. 19, 2006.

(51) Int. Cl.
*B28B 11/08* (2006.01)

(52) U.S. Cl. ..... 264/680; 264/310; 264/312; 264/632; 264/633; 264/679

(58) Field of Classification Search ..... 264/310, 264/312, 632, 633, 679, 680; 425/266, 267, 425/268, 459, 400
See application file for complete search history.

(56) References Cited

U.S. PATENT DOCUMENTS

| | | | | |
|---|---|---|---|---|
| 1,409,257 | A | 7/1921 | Staley | |
| 1,551,728 | A * | 9/1925 | Burger | 425/265 |
| 1,732,339 | A * | 10/1929 | Osborne | 425/263 |
| 1,751,049 | A * | 3/1930 | Miller | 425/214 |
| 2,370,410 | A * | 2/1945 | Miller | 264/679 |
| 2,450,437 | A * | 10/1948 | Miller | 264/312 |
| 2,465,450 | A | 3/1949 | Hawk | |
| 2,599,910 | A * | 6/1952 | Guthrie | 425/267 |
| 2,638,653 | A * | 5/1953 | Adams | 425/86 |
| 2,813,324 | A | 11/1957 | Watkin | |
| 2,876,522 | A | 3/1959 | Johnson | |
| 3,386,140 | A * | 6/1968 | Bruckner | 425/3 |
| 3,387,347 | A | 6/1968 | John | |
| 3,520,036 | A * | 7/1970 | Maloney | 425/90 |
| 3,605,218 | A * | 9/1971 | Rasmussen et al. | 425/459 |
| 3,778,212 | A | 12/1973 | Takahashi | |
| 3,796,105 | A | 3/1974 | Menard | |
| 3,894,830 | A | 7/1975 | Edwards | |
| 4,028,041 | A | 6/1977 | Zambrano, Jr. | |

(Continued)

FOREIGN PATENT DOCUMENTS

JP 1-244804 A 9/1989

*Primary Examiner* — Joseph S. Del Sole
*Assistant Examiner* — Seyed Masoud Malekzadeh
(74) *Attorney, Agent, or Firm* — Carrier Blackman & Associates, P.C.; William D. Blackman; Joseph P. Carrier

(57) ABSTRACT

A rotatable turntable tool is used in trimming wheel-thrown pottery. The turntable tool includes a base portion, a bearing member, and a cap portion which is rotatably attached to the base portion. A method of trimming an unfired clay workpiece includes steps of inverting the workpiece and placing it at a central portion of a wheel head on a potter's wheel; placing the turntable tool on top of a central portion of the inverted workpiece; pressing downwardly on the cap portion of the turntable tool while rotating said wheel head to stabilize the workpiece, whereby the base portion of the turntable tool rotates with the workpiece, while the cap portion is substantially restrained from rotating; and applying a trimming tool to an edge of the workpiece to remove unwanted clay therefrom.

17 Claims, 7 Drawing Sheets

U.S. PATENT DOCUMENTS 4,057,384 A * 11/1977 Reid ..... 425/459
4,102,622 A 7/1978 Simpson
4,222,577 A 9/1980 Giffin
4,332,542 A 6/1982 Matsui
4,368,021 A 1/1983 Ryckman
4,503,943 A 3/1985 Tsukui
4,585,240 A * 4/1986 Giffin ..... 279/111
4,689,001 A 8/1987 Yoder
4,702,920 A 10/1987 Goodman
4,806,090 A 2/1989 Finlay
4,857,256 A 8/1989 Fujii et al.
5,047,194 A 9/1991 Roufs et al.
5,230,909 A 7/1993 Stanly
5,244,376 A 9/1993 Meyers
5,479,867 A 1/1996 Blevins et al.
5,695,703 A * 12/1997 Craven et al. ..... 264/154
5,783,123 A * 7/1998 Edwards et al. ..... 264/39
6,419,319 B1 7/2002 Sakurai
7,195,474 B1 3/2007 Summers
7,200,895 B2 4/2007 Dayt
7,261,543 B2 8/2007 Lester
7,504,064 B2 3/2009 Jo
7,641,464 B2 * 1/2010 Griffin et al. ..... 425/267
2003/0215538 A1 11/2003 Oakes
2004/0025850 A1 2/2004 Hiraiwa et al.
2004/0033284 A1 2/2004 Adachi et al.
2004/0142061 A1 7/2004 Oakes
2005/0025850 A1 2/2005 D'Estais
2005/0108851 A1 5/2005 Dayt
2006/0016060 A1 * 1/2006 Lester ..... 29/428
2008/0203613 A1 8/2008 Jo
2008/0258336 A1 10/2008 Lester

* cited by examiner

METHOD OF TRIMMING UNFIRED POTTERY USING A TURNTABLE APPARATUS

CROSS-REFERENCE TO RELATED APPLICATIONS

The present invention is a divisional of U.S. patent application Ser. No. 11/824,377, filed on 29 Jun. 2007. The present application claims priority under 35 USC 119(e) based on U.S. provisional patent application No. 60/831,758 filed on Jul. 19, 2006. The subject matter of each of the referenced priority documents, including claims, specification and drawings, is incorporated by reference herein.

BACKGROUND OF THE INVENTION

1. Field of the invention

The present invention relates to a method of trimming unfired pottery, using a turntable tool. The tool includes a base which spins with a pottery workpiece, and a cap member operatively attached to the base and adapted to rotate relative to the base.

2. Description of the Background Art

It has been a common practice in trimming pottery for an artisan to invert a wheel-thrown workpiece on a rotatable wheel head of a potter's wheel, when the workpiece has partially dried to a stage referred to in the art as "leather hard"; to center the workpiece on the wheel head; and to press downwardly on the inverted base of the workpiece during trimming. It has also been known to place an inverted metal lid in the center of the base of the workpiece during a trimming operation on unfired pottery. This lid may be, for example, a lid from a baby food jar. Then, the artisan places a finger in the center of the lid and applies a light downward pressure to the workpiece, through the lid, while the wheel spins at an appropriate trimming speed, and this stabilizes the workpiece on the wheel head and distributes the finger pressure, while the artisan trims away unwanted superfluous clay from the exterior and base of the workpiece.

Using this type of inverted lid, however, does not entirely avoid the occurrence of friction between the spinning lid and the user's fingertip. Such friction may generate heat and be uncomfortable for the user.

Many different designs for turntables have been patented, for a number of different applications. Examples of some of the known turntables include U.S. Pat. No. 1,409,257 (Staley), U.S. Pat. No. 1,732,113 (Van Der Meer), U.S. Pat. No. 4,117,627 (Slingerland, Jr.), U.S. Pat. No. 4,549,714 (Busch), U. S. Pat. No. 5,479,867 (Blevins et al.), U.S. Pat. No. 5,779,309 (Lu), and U.S. Pat. No. 5,783,123 (Edwards et al.)

Although the known turntables have some utility for their intended purposes, a need still exists in the art for an improved tool for use in trimming unfired clay pots, and to an improved method of trimming unfired clay pots using such a turntable tool. In particular, there is a need for an improved trimming tool which will overcome the difficulties encountered with the known art, and which will speed up the trimming process.

SUMMARY OF THE INVENTION

Accordingly, it is an object of the present invention to provide an improved method and turntable tool for use in stabilizing an unfired clay workpiece during a trimming operation thereon, in an intermediate stage of manufacture.

A turntable apparatus according to an illustrative embodiment includes a base member, a bearing member which fits into an opening in the base member, and a cap member including a dependent central post which fits into a hole in the center of the bearing.

The base member may be textured on a bottom surface thereof, to better grip the clay surface of a workpiece during use. The base member may further have a plurality of open cutouts formed in the lower surface thereof, and may also have a plurality of radial ribs on the underside thereof extending between the cutouts.

The bearing member may be a bearing, such as a sealed bearing, or alternatively, may be an annular bushing. Where a bushing is used, it may be formed from sintered plastic or metal, impregnated with a lubricant.

The cap member includes a relatively thin upper disc, which may have a shallow recess formed centrally therein to receive a fingertip of a user. The cap member also includes a post attached to and extending downwardly from the upper disc, where the post is dimensioned and configured to fit into the central hole of the bearing member.

The diameter of the upper disc may be in a range between 3 cm and 7 cm.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

The present invention provides an improved turntable tool, and method of using the disclosed tool to stabilize an unfired clay workpiece during a trimming operation thereon, in an intermediate stage of manufacturing the workpiece.

Figure 1:
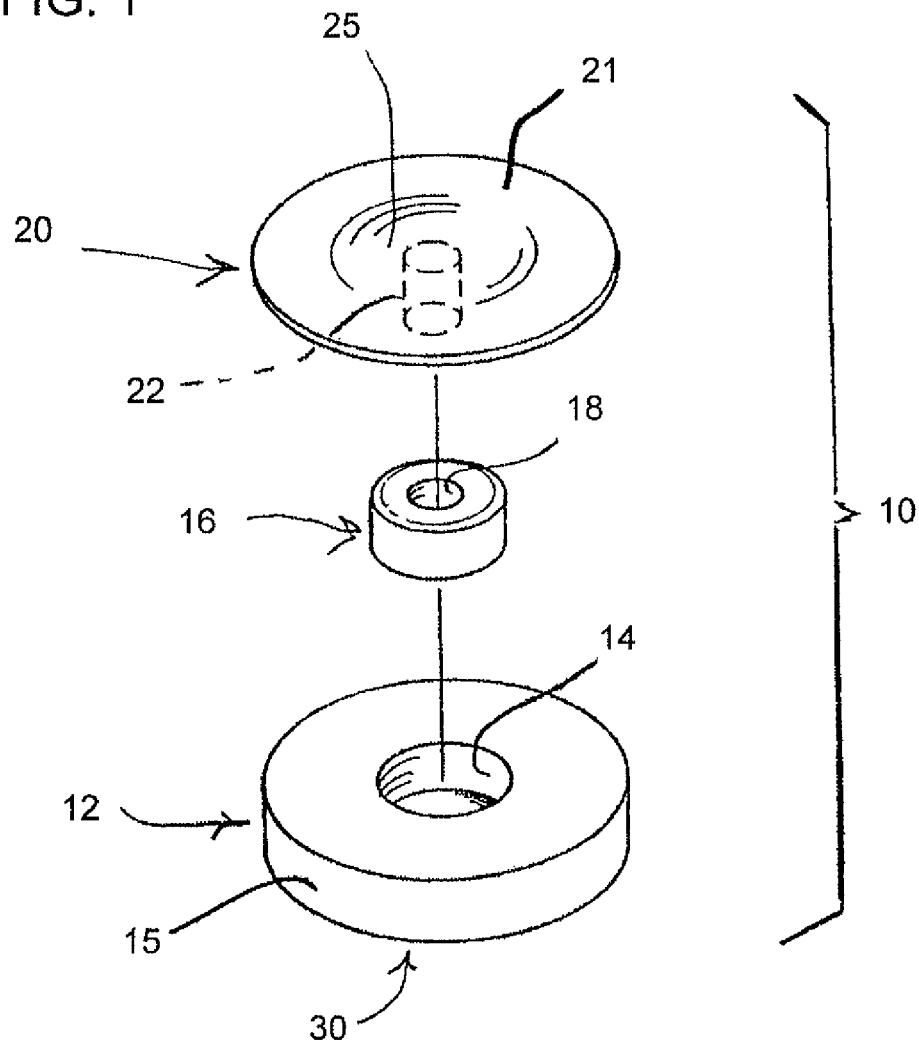
FIG. 1 is an exploded perspective view of a turntable tool according to a first illustrative embodiment of the present invention.

Referring now to the drawings, a turntable apparatus according to a first illustrative embodiment of the invention is shown generally at 10 in FIG. 1, in exploded perspective view. The turntable apparatus 10 includes a base member 12, a bearing member 16, and a cap member 20. Each of these components will be discussed in further detail below.

In the first embodiment of the turntable apparatus 10, the base member 12 is formed generally in the shape of a flattened cylinder with a hollow cylindrical recess 14 formed centrally therein, to receive the bearing member 16. The base member 12 includes a substantially smooth and unbroken side wall 15 extending therearound. Also in the first depicted embodiment, the base member 12 includes a closed floor portion 35 extending across a lower surface 30 thereof at the bottom of the recess 14, sealing the recess 14 from contact by water or other environmental elements below the tool. The base member 12 may be formed of a slightly resilient plastic material, so as to be non-brittle.

Figure 2A:
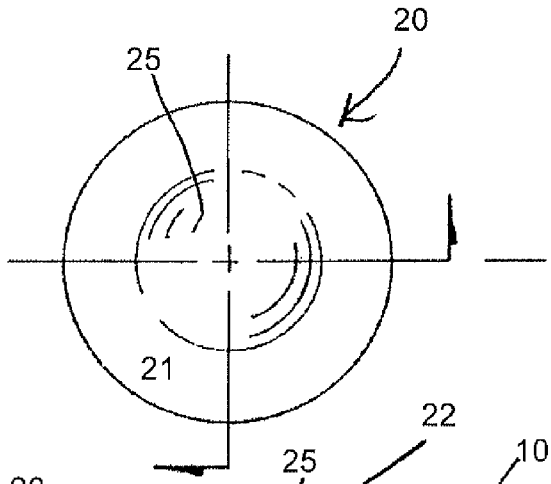
FIG. 2A is a top plan view of the turntable tool of FIG. 1.
Figure 2B:
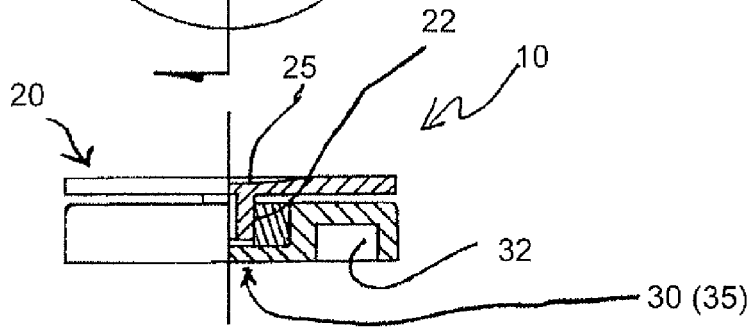
FIG. 2B is a partial side plan view and a partial sectional view of the turntable tool of FIG. 1.
Figure 2C:
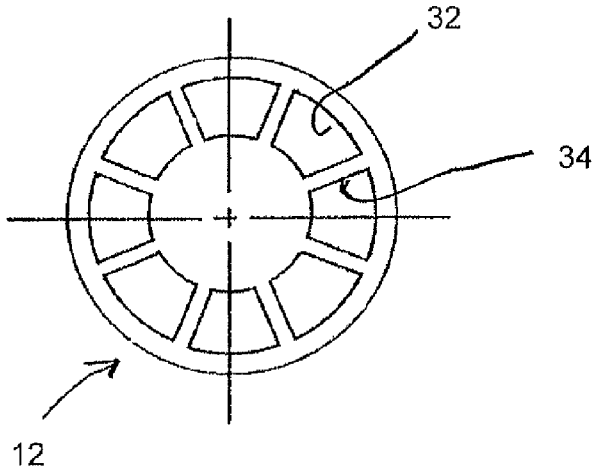
FIG. 2C is a bottom plan view of the turntable tool of FIG. 1.

The base member 12 may be knurled, or otherwise may be textured, on a lower surface 30 thereof. The lower surface 30 of the base member 12 may have a plurality of open cutouts 32 (FIG. 2B, 2C) formed therein to create such a textured surface. The lower surface 30 may also have a plurality of radial ribs 34 thereon extending between the cutouts 32, as shown in FIG. 2C.

The bearing member 16 is generally annular in shape, with a hollow central hole 18 formed centrally therein to receive a post 22 of the cap member 20. The bearing member 16 is configured and dimensioned to fit snugly inside of the recess 14 of the base member 12, with a slight interference fit to retain the bearing member therein. The bearing member 16 may be a multi-component bearing assembly, such as a sealed ball bearing or roller bearing. Alternatively, the bearing member 16 may be an annular bushing. Where a bushing is used, it may be formed from sintered plastic or metal, and optionally, may be impregnated with a wax or with another lubricant. However, the relatively low speed at which the cap member 20 is expected to rotate, in relation to the base 12, makes the use of a lubricant optional.

The cap member 20 includes a relatively thin upper disc 21, which may have a shallow recess 25 formed centrally therein to receive a fingertip of a user. The diameter of the upper disc 21 may be in a range between 3 cm and 7 cm. The cap member 20 also includes a cylindrical post 22, integrally attached to and extending downwardly from the upper disc. The post 22 is dimensioned and configured to fit into the central hole 14 of the bearing member, and to suspend the upper disc 21 slightly above, and spaced away from the base member 12, so as to avoid direct contact therebetween. This spacing provides a narrow gap between the upper disc 21 and the base member.

Figure 5:
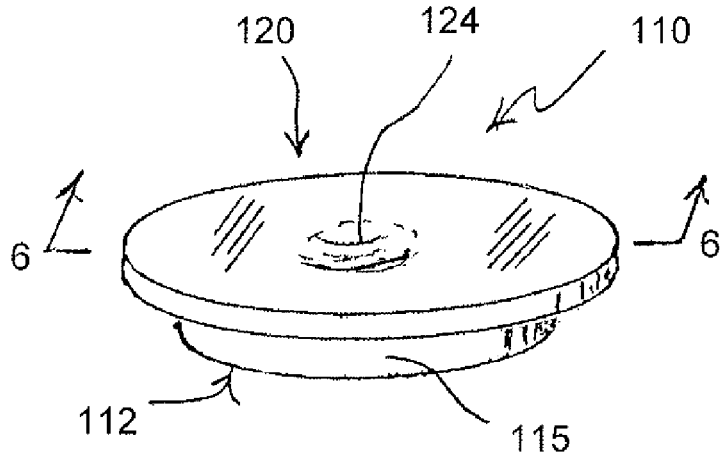
FIG. 5 is a perspective view of a turntable tool according to a second illustrative embodiment of the present invention.
Figure 6:
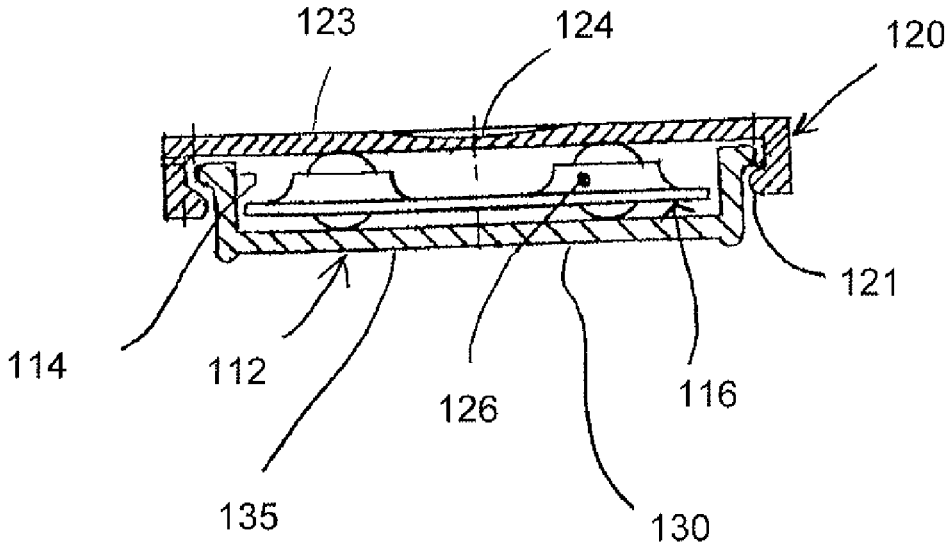
FIG. 6 is a cross-sectional view of the turntable tool of FIG. 5, taken along the line 6-6.
Figure 7:
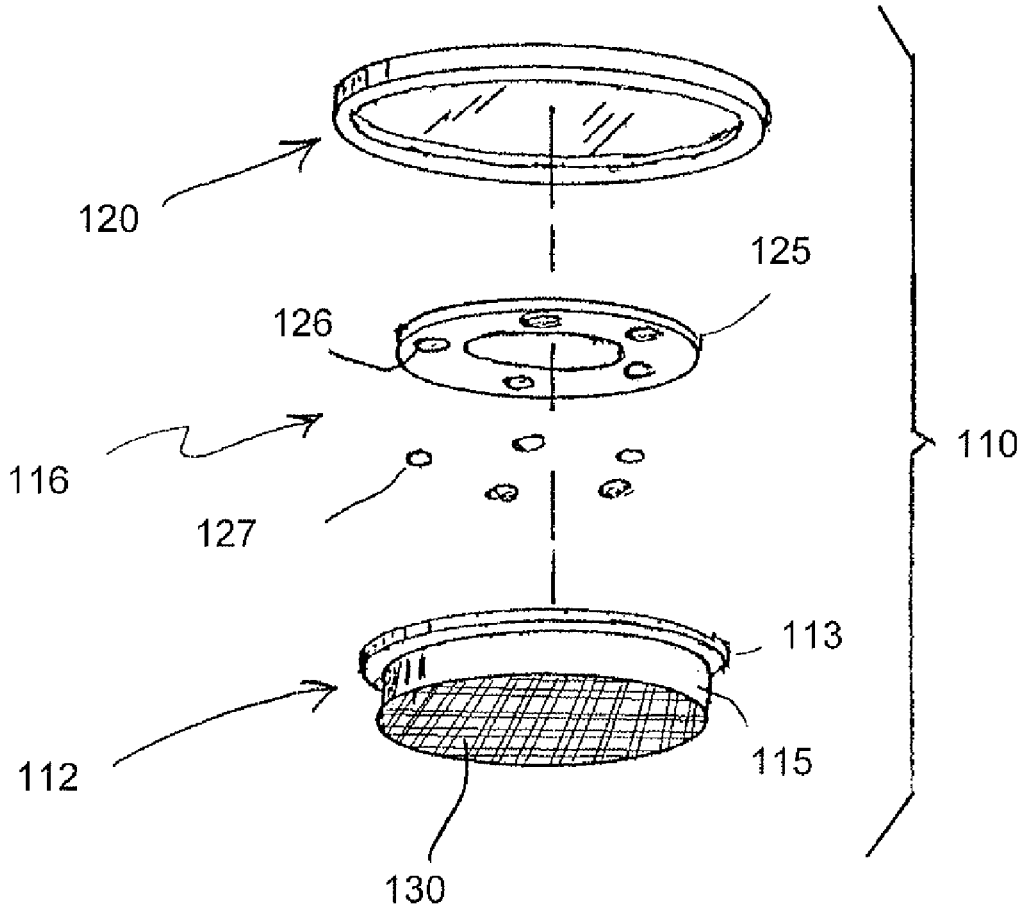
FIG. 7 is an exploded lower perspective view of the turntable tool of FIGS. 5-6.

Referring now to FIGS. 5-7, a turntable apparatus according to a second illustrative embodiment of the invention is shown generally at 110 in FIG. 5, and this same apparatus is shown in cross-section in FIG. 6, and in exploded perspective view in FIG. 7. The turntable apparatus 110 in this second embodiment includes a base member 112, a bearing subassembly 116, and a cap member 120. Each of these components will be discussed in further detail below.

In the turntable apparatus 110 according to the second embodiment, the base member 112 is formed generally in the shape of a flattened cylinder with a hollow cylindrical open space 114 formed therein, to receive the bearing subassembly 116. The base member 112 includes a substantially smooth and unbroken side wall 115 extending therearound, with an upper lip flange 113 extending substantially horizontally outwardly at the top of the side wall 115, as shown. The upper lip flange 113 is provided for cooperating with a lower lip flange 121 of the cap member 120, to retain the cap member on the base member through an interference fit between the upper lip flange 113 and the lower lip flange 121.

Also in the second embodiment, the base member 112 includes a closed floor portion 135 extending across a lower surface 130 thereof at the bottom of the recess 114, sealing the recess from contact by water or other environmental elements below the turntable tool. The base member 112 may be formed of a slightly resilient plastic material such as polyethylene or another suitable polymer, so as to be non-brittle.

The base member 112 may be knurled, or otherwise may be textured, on the lower surface 130 thereof, as shown in FIG. 7.

The bearing subassembly 116 includes a perforated ring member 125 which is generally annular in shape, and which may have a hollow central hole 118 formed centrally therein. The perforated ring member 125 has a number of evenly-spaced collars 126 formed therein, including hollow apertures in each of the collars to retentively receive ball bearings 127. The bearing subassembly 116 is configured and dimensioned to fit loosely inside of the recess 114 of the base member 112. The bearing subassembly 116 may be a multi-component bearing assembly, as shown. Alternatively, the bearing subassembly 116 may be replaced with a sealed bearing assembly or by an annular bushing. Where a bushing is used, it may be formed from sintered plastic or metal, and optionally, may be impregnated with a wax or with another lubricant. However, the relatively low speed at which the cap member 120 is expected to rotate, in relation to the base 112, makes the use of a lubricant optional.

The cap member 120 includes a relatively thin upper disc 123, which may have a shallow recess 124 formed centrally therein to receive a fingertip of a user. The width, or diameter of the upper disc 123 may be in a range between 3 cm and 7 cm.

The cap member 120 also includes an integral side wall 122, integrally attached to and extending downwardly from an outer edge portion of the upper disc 123. The side wall 122 of the cap member 120 is dimensioned and configured to fit outside of side wall 115 of the base member 112, and the bearing subassembly 116 suspends the upper disc 123 slightly above, and spaced away from the base member 112, so as to avoid direct contact therebetween. This spacing provides a narrow gap between the upper disc 123 and the base member 112.

Referring now to FIGS. 3A-3C and 4, an illustrative method of trimming an unfired clay workpiece, using the turntable tool 10 or 110, will now be described.

Those in the relevant art will understand that immediately after a clay workpiece has been hand-formed on a potter's wheel 36 (FIG. 3A), the workpiece is quite soft and malleable, and is generally too soft to undergo an immediate trimming operation. Therefore, the workpiece is air-dried for a period of time, until it is partially dried to an intermediate state known in the art as "leather hard", whereupon it can withstand the forces exerted thereon in a trimming operation. This drying operation can take place overnight in a "wet box", or the workpiece may be allowed to sit out uncovered to dry immediately after it is formed, where the user is available to wait for the partial drying process to take place.

Figure 3A:
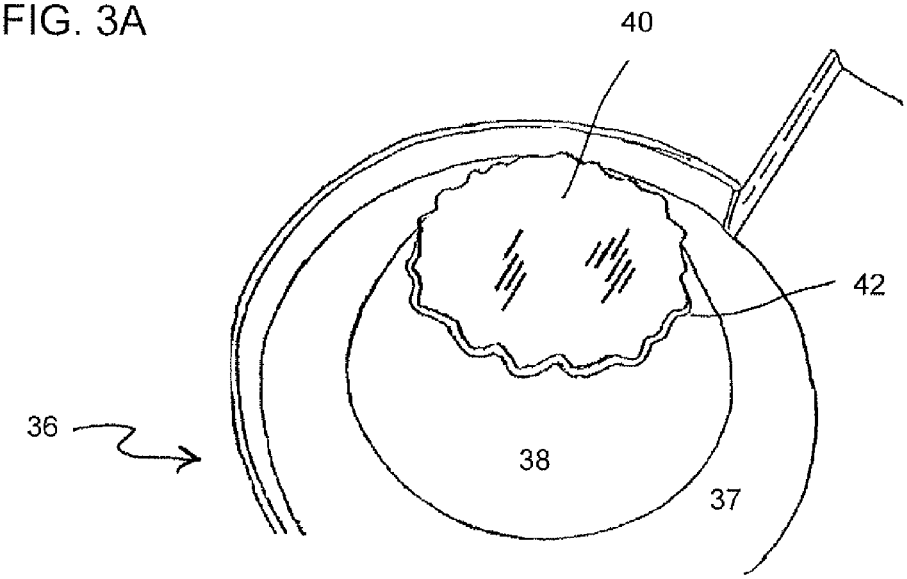
FIG. 3A is an environmental perspective view of a first step in a trimming process according to the present invention, showing an inverted clay workpiece centered on a wheel head.

Once the workpiece 38 has attained a leather-hard condition, it is inverted and placed at the center of a rotatable wheel head 37 of a potter's wheel 36, with the base 40 of the workpiece oriented facing upwardly. The base 40 includes a rough, uneven outer edge portion 42 in need of trimming. This step of the method is depicted in FIG. 3A, and is also shown at 50 in the method flowchart of FIG. 4.

Figure 3B:
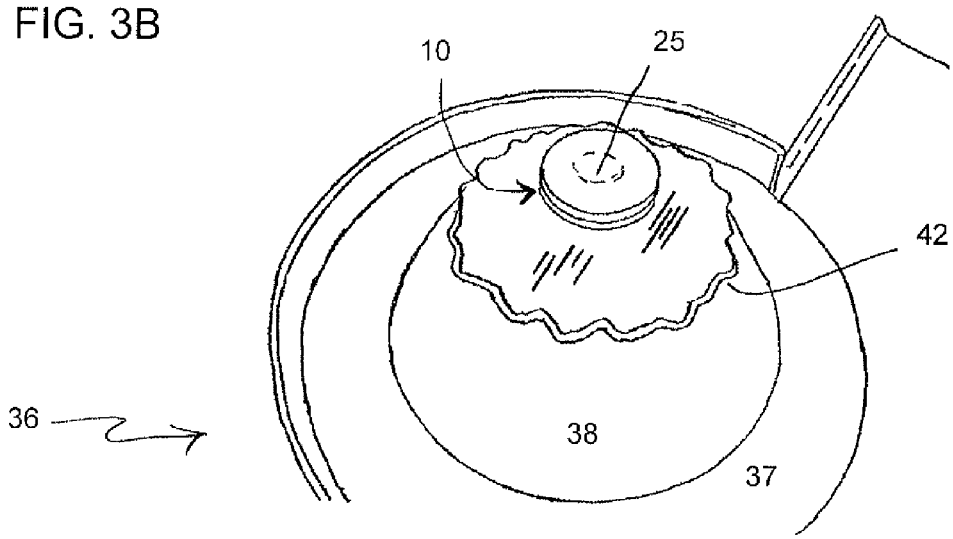
FIG. 3B is an environmental perspective view of a second step in the trimming process according to the present invention, showing a turntable tool according to the invention centered on an inverted workpiece.

Once the workpiece 38 has been centered on the wheel head 37, the turntable tool 10 or 110 is then placed on a central portion of the inverted workpiece base 40, with the cap portion of the tool facing upwardly. This step of the method is depicted in FIG. 3B, and is shown at 52 in the method flowchart of FIG. 4.

Figure 3C:
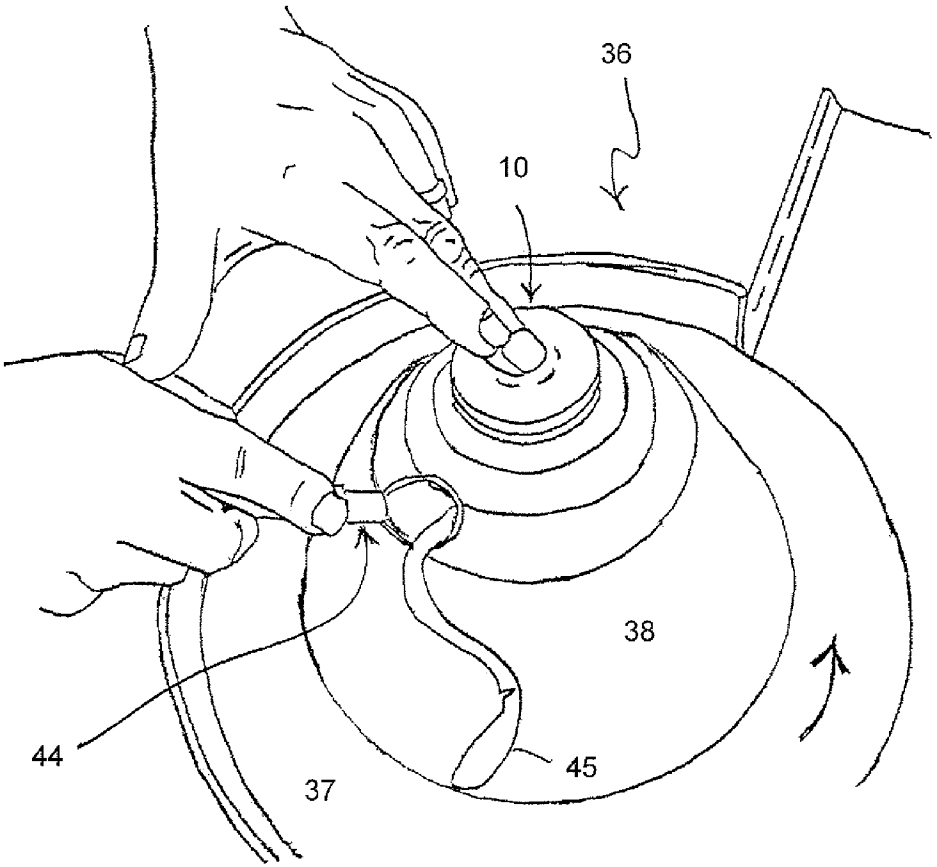
FIG. 3C is an an environmental perspective view of a third step in the trimming process according to the present invention, showing finger pressure being applied downwardly on the turntable tool while a user removes unwanted clay from the base of the workpiece using a conventional metal trimming tool.
Figure 4:
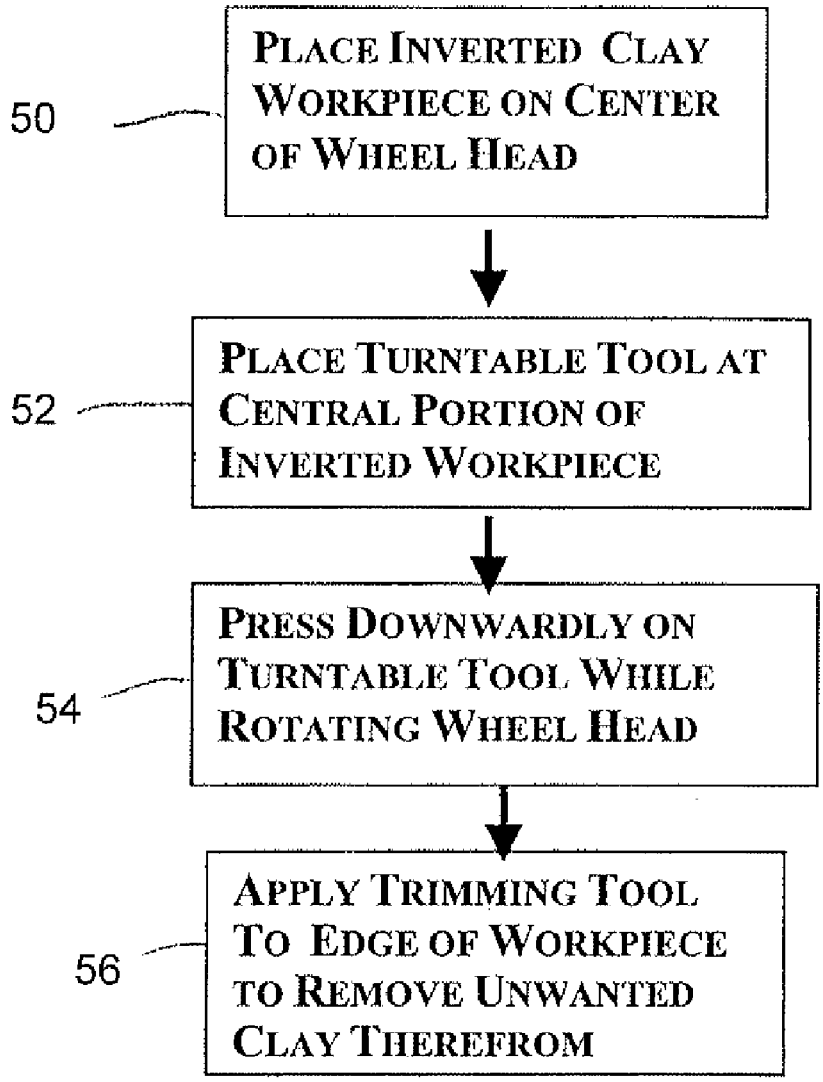
FIG. 4 is a schematic diagram showing a sequence of steps in an illustrative method according to the present invention.

After the turntable tool 10 or 110 has been centered on the base 40 of the workpiece 38, the user then presses downwardly on the turntable tool to stabilize the workpiece, while rotating the wheel head at an appropriate trimming speed. A selected fingertip of the user fits engagingly into the recess 25 in the top of the cap portion 20 during this step. The base portion 12 of the turntable tool rotates with the workpiece 38 and spins about the stationary post 22 of the cap portion 20, while the cap portion 20 remains substantially still. This step of the method is depicted in FIG. 3C, and is shown at 54 in the method flowchart of FIG. 4.

In the next step of the method hereof, a trimming tool 44 is applied to the rough edge 42 of the workpiece 38, to remove unwanted clay 45 therefrom. This step of the method is also depicted in FIG. 3C, and is shown at 56 in the method flowchart of FIG. 4.

Optionally, the trimming tool may then be removed, and additional clay may be removed from a central portion of the base.

After the trimming operation has been completed, the workpiece is allowed to dry completely over a period of days until it reaches a "bone-dry" condition, after which it is vitrified in a conventional firing process in a kiln. This may be a two-stage process in which a glaze is applied to the finished workpiece after an initial bisque firing, and the glaze is then melted in a final, high-temperature firing.

Although the present invention has been described herein with respect to a number of specific illustrative embodiments, the foregoing description is intended to illustrate, rather than to limit the invention. Those skilled in the art will realize that many modifications of the preferred embodiment could be made which would be operable. All such modifications, which are within the scope of the claims, are intended to be within the scope and spirit of the present invention.

Having, thus, described the invention, what is claimed is:

1. A method of trimming a clay workpiece, comprising the steps of:

a) inverting the workpiece and placing it at a central portion of a wheel head on a potter's wheel;

b) placing a turntable tool on top of a central portion of the inverted workpiece, said turntable tool comprising a base member and a cap member rotatably attached to said base member, wherein the base member and the cap member are configured to permit rotatable movement of the base member relative to the cap member;

c) pressing downwardly on the cap member of the turntable tool while rotating said wheel head to stabilize the workpiece, whereby the base member of the turntable tool rotates with the workpiece, while the cap member is substantially restrained from rotating; and d) applying a trimming tool to an edge of the workpiece to remove unwanted clay therefrom.

2. The method of claim 1, wherein the turntable tool comprises:

said base member having a central opening formed therein;

a bearing which fits in the central opening of the base member and which has a central hole formed therein; and said cap member comprising an upper disc, and a post attached to and extending downwardly from the upper disc, the post dimensioned and configured to fit into the central hole of the bearing.

3. The method of claim 2, wherein the upper disc has a diameter in a range between 3 and 7 centimeters.

4. The method of claim 2, wherein the upper disc has a shallow recess formed centrally therein to receive a fingertip of a user, and wherein the step of pressing downwardly comprises pressing into the shallow recess of the upper disc.

5. The method of claim 2, wherein the base member is textured on a bottom surface thereof, and wherein the textured bottom surface of the base member frictionally engages a surface of the inverted workpiece.

6. The method of claim 2, wherein the base member has a plurality of open cutouts formed in a lower surface thereof.

7. The method of claim 6, wherein the lower disc has a plurality of radial ribs on an underside thereof extending between said cutouts.

8. A method of trimming a clay workpiece, comprising the steps of:

a) inverting the workpiece and placing it at a central portion of a wheel head on a potter's wheel;

b) placing a turntable tool on a central portion of the inverted workpiece, said turntable tool comprising:

a base member having a central opening formed therein;

a bearing which fits in the central opening of the base member and which has a central hole formed therein; and a cap member comprising an upper disc, and a post attached to and extending downwardly from the upper disc, the post dimensioned and configured to fit into the central hole of the bearing, wherein the base member is rotatably movable relative to the cap member;

c) pressing downwardly on the turntable tool while rotating said wheel head to stabilize the workpiece, whereby the base portion of the turntable tool rotates with the workpiece, while the cap portion is substantially restrained from rotating; and d) applying a trimming tool to an edge of the workpiece to remove unwanted clay therefrom.

9. The method of claim 8, wherein the upper disc has a diameter in a range between 3 and 7 centimeters.

10. The method of claim 8, wherein the upper disc has a shallow recess formed centrally therein to receive a fingertip of a user, and wherein the step of pressing downwardly comprises pressing into the shallow recess of the upper disc.

11. The method of claim 8, wherein the base member is textured on a bottom surface thereof, and wherein the textured bottom surface of the base member frictionally engages a surface of the inverted workpiece.

12. The method of claim 8, wherein the base member has a plurality of open cutouts formed in a lower surface thereof.

13. The method of claim 12, wherein the lower disc has a plurality of radial ribs on an underside thereof extending between said cutouts.

14. A method of trimming a clay workpiece, comprising the steps of:

a) inverting the workpiece and placing it at a central portion of a wheel head on a potter's wheel;

b) placing a turntable tool on a central portion of the inverted workpiece, said turntable tool comprising:

a base member having a central opening formed therein, wherein the base member is textured on a bottom surface thereof, and wherein the textured bottom surface of the base member frictionally engages the inverted workpiece;

a bearing which fits in the central opening of the base member and which has a central hole formed therein; and a cap member comprising an upper disc having a shallow recess formed centrally therein to receive a fingertip of a user, and a post attached to and extending downwardly from the upper disc, the post dimensioned and configured to fit into the central hole of the bearing, wherein the base member is rotatably movable relative to the cap member;

c) pressing downwardly on the turntable tool by pressing into the shallow recess of the upper disc while rotating said wheel head to stabilize the workpiece, whereby the base portion of the turntable tool rotates with the workpiece, while the cap portion substantially restrained from rotating; and d) applying a trimming tool to an edge of the workpiece to remove unwanted clay therefrom.

15. The method of claim 14, wherein the upper disc has a diameter in a range between 3 and 7 centimeters.

16. The method of claim 14, wherein the base member has a plurality of open cutouts formed in a lower surface thereof.

17. The method of claim 16, wherein the lower disc has a plurality of radial ribs on an underside thereof extending between said cutouts.

* * * * *